US006041476A

United States Patent [19]

deNormand

[11] Patent Number: 6,041,476

[45] Date of Patent: Mar. 28, 2000

[54] INVERTED BLOCK AND TACKLE WINDOW BALANCE

[75] Inventor: Richard S. deNormand, Rochester, N.Y.

[73] Assignee: Caldwell Manufacturing Company, Rochester, N.Y.

[21] Appl. No.: 08/975,728

[22] Filed: Nov. 21, 1997

[51] Int. Cl.[7] ..... B66D 3/08

[52] U.S. Cl. ..... 16/197; 16/196; 49/445; 254/393

[58] Field of Search ..... 16/193, 196, 197, 16/198, 401, 402; 49/445, 446; 492/30, 47; 254/393, 404, 416

[56] References Cited

U.S. PATENT DOCUMENTS

| | | | |
|---|---|---|---|
| 6,584 | 7/1849 | Hoffman . | |
| 138,944 | 5/1873 | Shaw | 16/213 |
| 329,005 | 10/1885 | Blodgett | 16/213 |
| 464,795 | 12/1891 | Dodge . | |
| 527,306 | 10/1894 | Wern | 254/393 |
| 1,523,733 | 1/1925 | Trout | 254/404 |
| 1,668,497 | 5/1928 | Fishback . | |
| 1,713,586 | 5/1929 | Wright | 254/404 |
| 1,800,700 | 4/1931 | Patton . | |
| 2,196,948 | 4/1940 | Tremblay | 16/215 |
| 2,262,990 | 11/1941 | Cross et al. . | |
| 2,336,406 | 12/1943 | Kreuscher . | |
| 2,459,290 | 1/1949 | Rozner . | |
| 2,625,447 | 1/1953 | Derenter, III | 254/393 |
| 2,663,896 | 12/1953 | Trammell, Sr. et al. | 49/445 |
| 3,055,044 | 9/1962 | Dinsmore . | |
| 3,150,420 | 9/1964 | Brenner . | |
| 4,078,336 | 3/1978 | Prosser . | |
| 4,190,930 | 3/1980 | Prosser . | |
| 4,240,614 | 12/1980 | Comer, Jr. | 254/393 |
| 4,332,054 | 6/1982 | Paist et al. | 16/197 |
| 4,503,641 | 3/1985 | Swan . | |
| 4,586,291 | 5/1986 | Swan . | |
| 4,654,928 | 4/1987 | Flight . | |
| 4,689,850 | 9/1987 | Flight | 16/197 |
| 4,914,862 | 4/1990 | Gregory | 49/445 |
| 4,949,425 | 8/1990 | Dodson et al. | 16/DIG. 20 |
| 5,530,991 | 7/1996 | deNormand et al. . | |

*Primary Examiner*—Chuck Y. Mah
*Assistant Examiner*—Donald M. Gurley
*Attorney, Agent, or Firm*—Eugene Stephens & Associates

[57] ABSTRACT

Pulleys of a block and tackle window balance include hub steps that interact with other components to reduce the introduction of dirt and dust particles into areas vulnerable to wear. The hub steps of some of the pulleys are recesses formed about the axial bores of the pulleys that mate with protrusions on an axle and a washer. The hub steps of other pulleys are protrusions that abut a support plate and heads of rivets that act as axles. The hub steps allow inverse mounting of the window balance so that the balance can be mounted in a shoe channel for movement with a sash of the window, attached to the sash shoe, and the cord can be attached to the jamb or frame, thus increasing sash travel.

23 Claims, 2 Drawing Sheets

INVERTED BLOCK AND TACKLE WINDOW BALANCE

TECHNICAL FIELD

The invention relates to the field of block and tackle window balances for offsetting the weight of a window sash throughout a range of travel within a window frame.

BACKGROUND OF THE INVENTION

Block and tackle window balances have become popular because of their compact size and ease of installation. They combine a system of pulleys with an extension spring to convert high spring tension applied over a short working distance to a lower spring tension applied over a longer working distance. The extension spring and pulley system are arranged within a rigid balance channel, with the extension spring anchored at one end of the balance channel and the pulley system anchored at the other end. In most block and tackle balances, the balance channel is mounted in the jamb of the window frame; and a cord, which is reeved through the pulley system, is attached to a sash shoe that slides in the jamb with the sash. The extension spring and pulley system are sized so that a desired lifting force is applied to the window sash throughout the entire range of sash travel within the window frame. A disadvantage of this type of balance is that the movement of the sash is limited by the presence of the balance in the jamb. In some cases, the travel is limited so much that the lower sash of the open window blocks egress through the window in escaping a fire.

To solve the problem of limited sash movement, the balance can be mounted upside down in the window sash with the balance channel attached to the sash shoe and the cord attached to the window jamb or frame. However, prior art window balances of this kind tend to be susceptible to contamination from dirt and dust, especially when mounted upside down. Particles work their way between the pulley bores and the pulley axles, increasing friction and wear. Thus, prior art block and tackle window balances are not as durable or reliable as is desired.

Some prior art block and tackle window balances that are less susceptible to contamination require the use of bushings and other parts. This is disadvantageous in that the use of additional parts increases the complexity of the machines and the likelihood of their failure. Also, the additional parts increase the cost of manufacture and assembly of the window balances.

SUMMARY OF THE INVENTION

My inventive block and tackle window balance greatly reduces the invasion of the hub/axle interface by particulate contaminants. I form the pulleys with steps in their hubs so that they can engage mating steps on the rivets that serve as their axles. In addition, I mount the two pulleys at the open end of the balance so that they run against each other, effectively sealing the space between the pulley hubs. The steps in the pulley hubs can be recesses or protrusions, depending on their location and particular duty. My window balance provides better protection from dirt and dust contamination without the extra parts required by prior art window balances, keeping the balance relatively simple and less costly to manufacture and assemble. Additionally, because my window balance is less susceptible to contamination, it can be mounted to move with the sash of a window or to remain fixed relative to the frame of a window, depending on the requirements of a particular installation, and can be mounted invertedly without significantly reducing its useful life.

DESCRIPTION OF THE INVENTION

Figure 1:
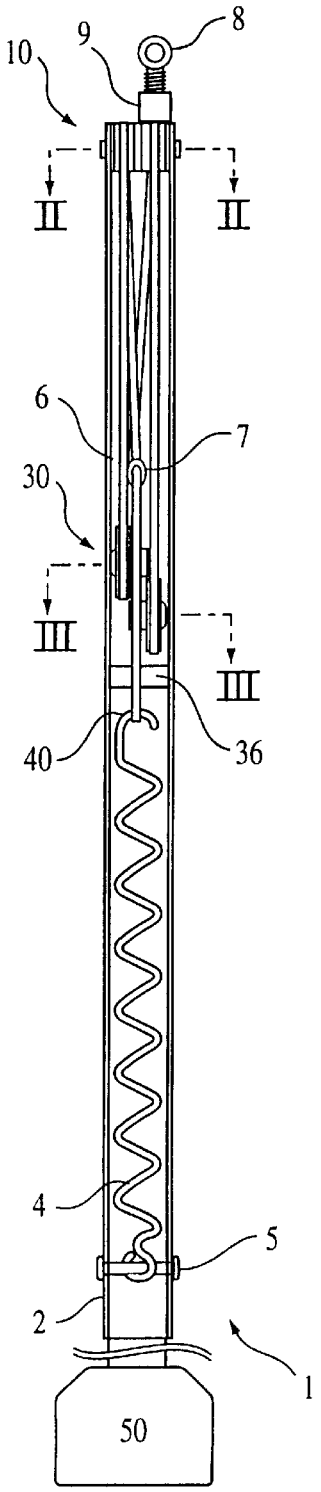
FIG. 1 is a top schematic view of the invention.

As seen in the accompanying Figures, my block and tackle window balance 1 includes a balance channel 2 preferably mounted in the shoe channel 55 of a window 51 and attached at one end to a sash shoe 50 that moves with the sash 53 in the shoe channel 55. I mount the shoe channel 55 on the jamb 54 of the window between the jamb 54 and the sash 53. The balance channel 2 supports a series of pulleys 11, 12, 31, 32 over which I reeve a cord 6. I attach an attachment end 8 of the cord 6 to the window jamb 54 or to the window frame 52. I attach a support plate end 7 of the cord 6 to a sliding support plate 35. The support plate 35 is biased against movement from a rest position by a spring 4 attached to the balance channel 2. Alternatively, a more conventional mounting arrangement can be used with the balance channel 2 fixed relative to the window jamb 54 and the attachment end 8 of the cord attached to the sash shoe 50.

Figure 2:
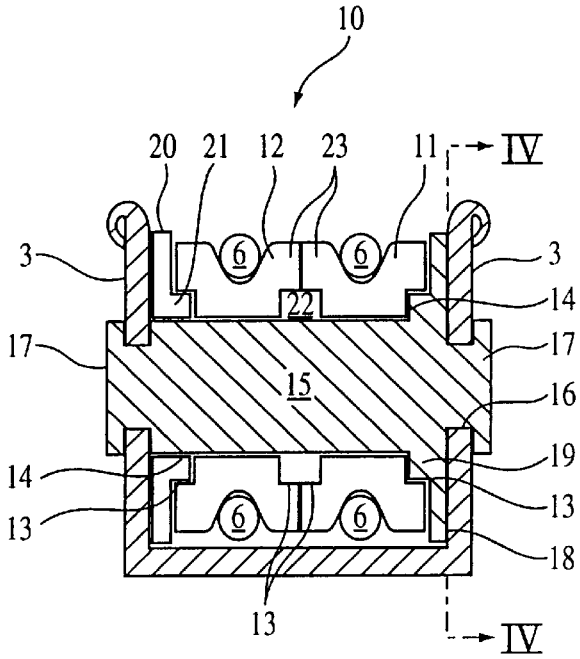
FIG. 2 is a cross section taken along line II—II in FIG. 1 showing the first pair of pulleys.
Figure 3:
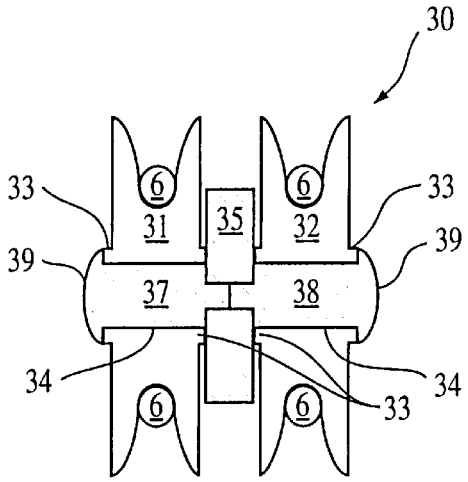
FIG. 3 is a cross section taken along line III—III in FIG. 1 showing the second pair of pulleys.

As seen particularly in FIG. 2, an axle 15 mounted in grooves 24 in one end of the balance channel 2 supports a first pair 10 of pulleys 11, 12. The pulleys 11, 12 in the first pair 10 sit adjacent one another and include hub steps 13 in the form of recesses about the axial bores 14 of the pulleys 11, 12. The sides or rims 23 of the pulleys 11, 12 adjacent one another can slide or rub against each other and effectively seal the cavity 22 formed by their hub steps 13 against contamination from dirt and dust.

Figure 4:
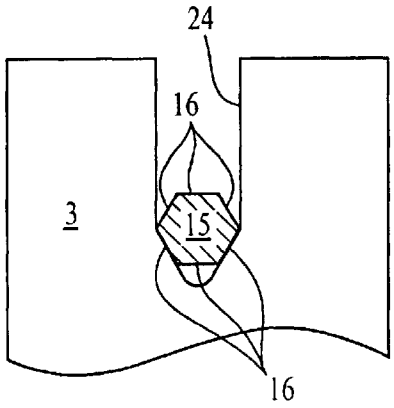
FIG. 4 is a view taken along line IV—IV in FIG. 2 to illustrate the flats of a preferred pulley axle and the groove in which the axle is mounted.
Figure 5:
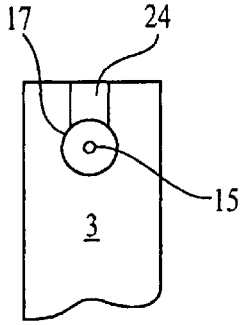
FIG. 5 is a side view of a portion of the invention as shown in FIG. 1.
Figure 6:
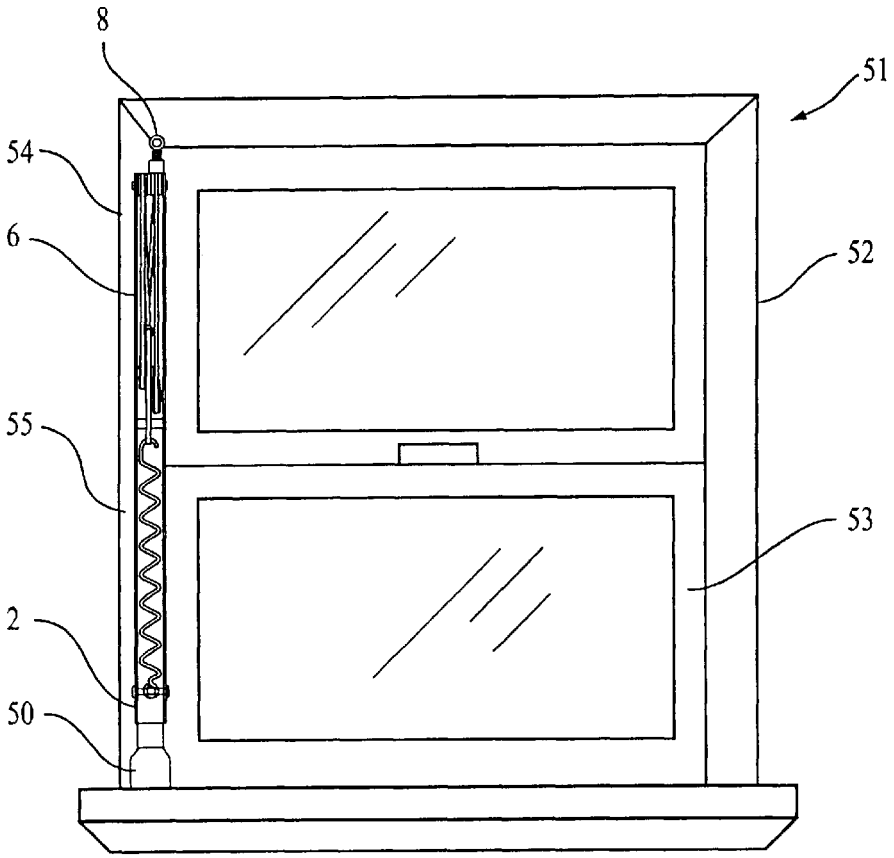
FIG. 6 is a schematic representation of the placement of my invention in a window.

The axle 15 is preferably a rivet including flats 16 formed over portions of the circumferential surface of the axle 15 such that the flats 16 engage the grooves 24 in the balance channel 2, holding the axle 15 against rotation. The preferred rivet 15 also includes heads 17 that prevent axial movement of the axle 15. As shown in FIG. 4, I prefer to use a hexagonal arrangement of the flats 16 similar to that used in common nuts and bolt heads. The axle 15 can also include a flange 18 with a protruding flange step 19 that mates with a hub step 13 of one the pulleys of the first pair, such as the first pulley 11. I prefer to mount a washer 20 on the axle 15 between the other of the pulleys of the first pair 10 (the second pulley 12) and the wall 3 of the balance channel. The washer 20 can include a protruding washer step 21 that mates with a hub step 13 of the second pulley 12. The mating steps 13, 19, 21 effectively seal the washer/pulley, flange/pulley, and pulley/axle bearing surfaces from contamination by dirt and dust particles, reducing wear of these parts and increasing the effective life of the window balance.

A second pair 30 of pulleys 31, 32 is mounted on the support plate 35. The pulleys 31, 32 of the second pair 30 also include hub steps 33, but I prefer to form these hub steps 33 as protrusions about the axial bores 34 of the pulleys 31, 32. Axles 37, 38, preferably in the form of rivets, rotatably mount the pulleys 31, 32 on the support plate 35, the heads 39 of the rivets engaging or abutting respective hub steps 33 of the pulleys 31, 32. I prefer to form the hub steps 33 so that they have substantially the same diameter as the heads 39 of the rivets 37, 38. The hub steps 33 of the pulleys 31, 32 farthest from the rivet heads 39 abut the support plate 35. As with the first pair of pulleys 10, the mating steps 33 and rivet heads 39 effectively seal the pulley/axle bearing surfaces from contamination by dirt and dust particles, reducing wear of these parts and increasing the effective life of the window balance.

When installed, one end 8 of the cord 6 is preferably attached to the window frame 52 or the window jamb 54, the other being attached to the support plate 35. In this arrangement, I slidingly mount the balance channel 2 in the shoe channel 55 with one end connected to the sash shoe 50 so that the balance channel 2 can move with the sash 53 in the shoe channel 55. Alternatively, the end 8 of the cord 6 can be attached to the sash shoe 50 mounted in the conventional manner, the other end 7 of the cord being attached to the support plate 35. In the conventional arrangement, the balance channel 2 is fixed with respect to the frame 52. In either arrangement, the support plate 35 slides in the balance channel 2. I prefer to run the cord 6 from the support plate 35 to the first pulley 11, then to the fourth pulley 32, then to the second pulley 12, then to the third pulley 31, and then out the end of the balance channel 2 in which the first pair of pulleys 10 is mounted. The end 8 of the cord 6 not attached to the support plate 35 includes a limit stop 9 to prevent the cord 6 from being pulled into the balance channel 2 when it is free.

The support plate 35 carries a guide 36 that keeps the support plate 35 properly aligned and oriented in the balance channel 2 while sliding and while resting. The support plate 35 also includes a spring attachment point 40, such as a hole, to which an end of a biasing spring 4 is attached. The other end of the biasing spring 4 is attached to the balance channel 2 via, for example, a support rivet 5. The spring 4 provides the force that balances the weight of the window sash 53. As the window sash 53 is moved, the cord 6 moves and rolls over the pulleys 11, 12, 31, 32, which rotate accordingly, and the support plate 35 slides. Travel of the support plate 35 is limited between its resting position and its extended position by the limit stop 9 on the cord 6 and the first pair of pulleys 10, respectively.

Parts List

1 Window balance
2 Balance channel
3 Walls of balance channel
4 Spring
5 Spring support/rivet
6 Cord
7 Support plate end of cord
8 Free end/attachment end of cord
9 Limit stop of cord
10 First pulley pair
11 First pulley
12 Second pulley
13 Hub steps/recesses of pulleys of first pair of pulleys
14 Axial bores of pulleys of first pair
15 Axle/rivet supporting first pair
16 Flats of axle
17 Heads of axle
18 Flange of axle
19 Flange step/protrusion
20 Washer
21 Washer step/protrusion
22 Cavity/space formed by hub steps of first pair
23 Rims of pulleys of first pair
24 Mounting groove of axle of first pair
30 Second pulley pair
31 Third pulley
32 Fourth pulley
33 Hub steps/protrusions of pulleys of second pair of pulleys
34 Axial bores of pulleys of second pair
35 Support plate
36 Guide for support plate
37 Support/rivet for third pulley
38 Support/rivet for fourth pulley
39 Heads of rivets for third and fourth pulleys
40 Attachment point for spring; hole in support plate
50 Pivot block or sash shoe
51 Window
52 Window frame
53 Window sash
54 Window jamb

I claim:

1. A block and tackle window balance comprising:

hub steps on each side of a pulley, the hub steps being formed coaxially with an axial bore of the pulley;

an axle on which the pulley is rotatably mounted so that the hub steps act to inhibit introduction of contaminants into the axial bore of the pulley;

a balance channel in which the axle is mounted, the balance channel being configured for mounting in one of a shoe channel, a sash, and a jamb of a window;

an end of the balance channel being attached to one of a sash shoe and a frame of a window;

a cord reeved over the pulley, a first end of the cord being attached to the other of the sash shoe and the frame of the window;

a spring having a first end attached to the balance channel and a second end connected to a second end of the cord; and wherein the hub steps are recesses and the axle includes an axle step that protrudes toward and mates with a hub step of the pulley.

2. The window balance of claim 1 wherein the axle step is a protrusion extending from a flange formed in the axle.

3. The window balance of claim 1 wherein flats formed on a circumferential surface of the axle engage grooves formed in the balance channel to hold the axle against rotation.

4. The window balance of claim 1 wherein the mating axle step and hub step form two substantially right angles in a path to the axial bore of the pulley, substantially reducing introduction of dust into the axial bore of the pulley.

5. The window balance of claim 1 wherein the axle step is a protrusion formed on a washer mounted on the axle.

6. The window balance of claim 1 wherein the pulley is one of a substantially identical pair of pulleys mounted adjacent each other on the axle so that they can rotate relative to one another, a rim of one pulley substantially engaging a rim of the other pulley such that facing recesses form a cavity between the pulleys.

7. A block and tackle window balance comprising:

hub steps on each side of a pulley, the hub steps being formed coaxially with an axial bore of the pulley;

an axle on which the pulley is rotatably mounted so that the hub steps act to inhibit introduction of contaminants into the axial bore of the pulley;

a balance channel in which the axle is mounted, the balance channel being configured for mounting in one of a shoe channel, a sash, and a jamb of a window;

an end of the balance channel being attached to one of a sash shoe and a frame of a window;

a cord reeved over the pulley, a first end of the cord being attached to the other of the sash shoe and the frame of the window;

a spring having a first end attached to the balance channel and a second end connected to a second end of the cord; and wherein the hub steps are protrusions and one of the hub steps engages a rivet head of an axle on which the pulley is rotatably supported, the axle being carried by a support plate that slides within the balance channel as the cord is played out of or drawn into the balance, the support plate being interposed between and attached to the second ends of the spring and the cord, the cord being biased by the spring against being played out of the balance.

8. The window balance of claim 7 wherein a pair of substantially identical axles carrying substantially identical pulleys is mounted on the support plate such that longitudinal axes of the axles are offset from one another.

9. The window balance of claim 7 wherein the support plate carries a guide that engages the balance channel to maintain the plate in proper alignment within the balance channel.

10. A block and tackle window balance comprising:

flats on a circumferential surface of an axle on which a pulley is rotatably mounted;

a balance channel in which the axle is mounted, the flats engaging a groove formed in the balance channel so that the axle is held against rotation, the balance channel being mounted for one of movement with a window sash and remaining fixed with respect to a window frame;

a cord reeved over the pulley, a first end of the cord being connected to the window frame when the balance channel is mounted for movement with the window sash, the first end of the cord being connected to the window sash when the balance channel is mounted for remaining fixed with respect to the window jamb;

a spring configured to provide a bias against withdrawal of the cord from the block and tackle window balance, a first end of the spring being connected to a second end of the cord, a second end of the spring being connected to the balance channel; and one of an end of the balance channel and the first end of the cord being configured for attachment to a sash shoe mounted in a shoe channel on the window jamb, the sash shoe being configured to slide in the shoe channel with the window sash as the window sash is moved, the end of the balance channel being configured for attachment to the sash shoe when the balance channel is mounted for movement with the window sash, and the first end of the cord being configured for attachment to the sash shoe when the balance channel is mounted for remaining fixed with respect to the window frame.

11. The window balance of claim 10 wherein the axle is a rivet and further comprises a flange arranged between the flats and the pulley.

12. The window balance of claim 11 wherein the flange includes a flange step on a pulley side of the flange, the flange step engaging a mating hub step of the pulley.

13. The window balance of claim 10 wherein a washer is mounted between a side of the pulley and a wall of the balance channel, the washer including a washer step that engages a mating hub step of the pulley.

14. The window balance of claim 10 wherein first and second pulleys are mounted adjacent one another on the axle in the balance channel, each pulley including hub steps such that a hub step of the first pulley faces a hub step of the second pulley and a hub step of each pulley faces a respective wall of the balance channel.

15. The window balance of claim 14 wherein the axle includes a step mating with a hub step of one of the pulleys.

16. The window balance of claim 14 further comprising a washer with a washer step thereon mating with a hub step of one of the pulleys.

17. The window balance of claim 14 further comprising third and fourth pulleys rotatably mounted on respective rivets on a support plate slidably mounted in the balance channel, the support plate being interposed between the spring and the cord such that the first ends of the spring and the cord are attached thereto, the pulleys including hub steps each engaging one of a respective rivet head and the support plate.

18. The window balance of claim 17 wherein the balance channel is mounted for movement with the window sash, an end of the balance channel being attached to the sash shoe, the cord running over each of the first, second, third, and fourth pulleys so that the first end of the cord can be attached to the window frame.

19. A block and tackle window balance comprising:

first hub steps on each side of a first pulley;

second hub steps on each side of a second pulley;

a first axle on which the first and second pulleys are rotatably mounted, the first and second pulleys lying adjacent one another on the axle so that they rub together;

third hub steps on each side of a third pulley;

fourth hub steps on each side of a fourth pulley;

second and third axles carrying the third and fourth pulleys, respectively, and being mounted on a support plate;

a balance channel non-rotatably supporting the first axle and slidingly supporting the support plate, the balance channel including first and second side walls and a bottom wall;

a cord reeved over the pulleys and having a first end attached to the support plate and a second end extending from a first end of the balance channel; and a spring having a fixed end attached to the balance channel and a movable end attached to the support plate.

20. The window balance of claim 19 wherein the first axle is mounted in grooves in the side walls of the balance channel and includes flats formed on a circumferential surface of the first axle corresponding to a region in which the first axle engages one of the grooves, the flats engaging the one of the grooves so that the axle is held against rotation.

21. The window balance of claim 19 wherein the first hub steps are recesses and the first axle includes a flange with a flange step formed thereon, the flange step engaging and mating with one of the first hub steps of the first pulley.

22. The window balance of claim 19 wherein the second hub steps are recesses and the first axle carries a washer adjacent the second pulley, the washer including a washer step facing the second pulley and mating with an adjacent second hub step of the second pulley.

23. The window balance of claim 19 wherein the hub steps of one of the third and fourth pulleys are protrusions, the axle of the one of the third and fourth pulleys comprising a rivet with a head engaging one of the protrusions, the other protrusion running against the support plate.

* * * * *